US005954441A

United States Patent [19]

Welschoff

[11] Patent Number: 5,954,441

[45] Date of Patent: Sep. 21, 1999

[54] COSMETIC APPLICATOR

[75] Inventor: Heinz Welschoff, 5621 NE. 22nd. Ave., #6, Ft. Lauderdale, Fla. 33303

[73] Assignees: Heinz Welschoff, Ft. Lauderdale, Fla.; William T. Wilkinson, Salem, N.J.

[21] Appl. No.: 09/017,559

[22] Filed: Feb. 2, 1998

[51] Int. Cl.[6] ..... A45D 40/04

[52] U.S. Cl. ..... 401/75

[58] Field of Search ..... 401/75, 76, 68

[56] References Cited

U.S. PATENT DOCUMENTS

| | | | |
|---|---|---|---|
| 1,520,430 | 12/1924 | Noble | 401/75 |
| 2,815,123 | 12/1957 | Safianoff | 401/75 |
| 3,358,699 | 12/1967 | Bau | 401/76 |

FOREIGN PATENT DOCUMENTS

| | | | |
|---|---|---|---|
| 2438986 | 5/1980 | France | 401/75 |
| 6-181813 | 7/1994 | Japan | 401/75 |

*Primary Examiner*—Charles R. Eloshway
*Attorney, Agent, or Firm*—Connolly Bove Lodge & Hutz LLP

[57] ABSTRACT

A cosmetic applicator includes a hollow tubular insert axially mounted in a hollow tubular body member for joint rotational movement. The forward end of the insert has at least one longitudinal slit which permits the insert to be in an open condition. A piston is axially mounted in the insert. The piston has a threaded outer surface disposed for threaded engagement with a threaded inner surface of the forward end of the insert. The threaded surfaces are brought into engagement with each other by mounting a cosmetic containing cartridge in between the forward end of the insert and the forward end of the body member until the cosmetic is received in a cup at the forward end of the piston. The components are dimensioned to form a plurality of seals at spaced locations on the inner surface of the cartridge.

21 Claims, 4 Drawing Sheets

COSMETIC APPLICATOR

BACKGROUND OF THE INVENTION

Applicators are known for various cosmetics such as lipstick, eye liners, eyebrow pencils, lip liners, eye shadow, or other types of cosmetics. When making lipstick, for example, it is known to fill a mold with the lipstick material, cool the mold and then remove the lipstick from the mold whereupon the lipstick is then inserted into a lipstick cup which is, in turn, inserted downwardly into a lipstick case. Such conventional procedures also include flaming steps to shine the cosmetic. The conventional techniques are not only costly but also have the disadvantage of not providing an effectively sealed applicator.

It would be desirable if techniques could be developed for more effectively forming cosmetic applicators which overcome the above disadvantages.

SUMMARY OF THE INVENTION

An object of this invention is to provide a cosmetic applicator which is effective in operation.

A further object of this invention is to provide such a cosmetic applicator which can be mass produced at low cost.

In accordance with this invention the cosmetic such as lipstick is extruded directly into a cartridge. The cartridge is assembled into a unit formed from a hollow tubular body member in which a hollow tubular insert is axially mounted for joint rotational movement. The forward end of the insert has at least one longitudinal slit, thereby permitting the forward end to tend to be in an open condition. A piston is axially mounted in the insert. The piston has a threaded outer surface disposed for threaded engagement with the threaded inner surface of the forward end of the insert. Threaded engagement is achieved when the cartridge is mounted between the body member and the insert to close the slit and thereby urge the two threaded surfaces into contact with each other.

In a preferred practice of this invention a pair of diametrically spaced longitudinal slits is formed in the forward end of the insert. Preferably the cosmetic is lipstick, although other forms of cosmetics could be used.

THE DRAWINGS

DETAILED DESCRIPTION

Figure 2:
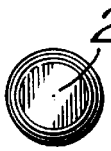
FIGS. 2–3 are end elevational views of the applicator shown in FIG. 1.
Figure 1:
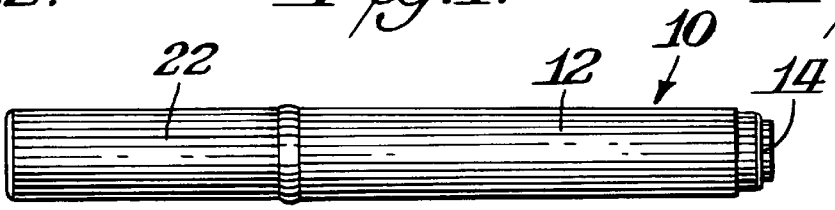
FIG. 1 is a side elevational view of a cosmetic applicator in accordance with this invention.
Figure 3:
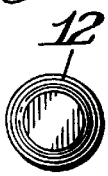
Figure 6:
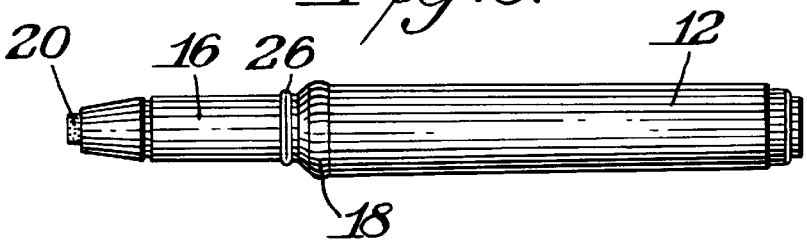
FIGS. 6 and 7 are top and bottom plan views of the applicator shown in FIGS. 4–5.
Figure 5:
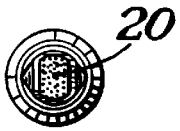
FIG. 5 is an end elevational view of the applicator shown in FIG. 4.
Figure 4:
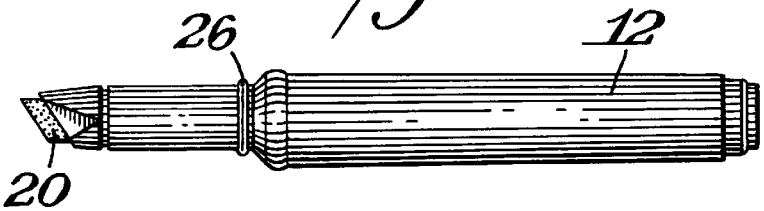
FIG. 4 is a view similar to FIG. 1 of the applicator with the cap removed.
Figure 7:
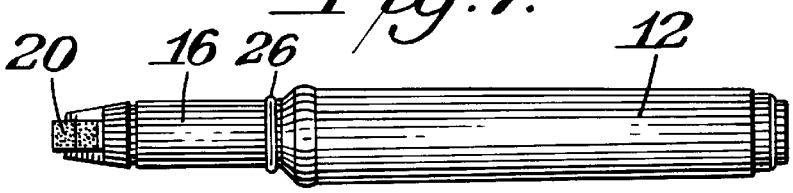

The present invention relates to a cosmetic applicator which generally comprises a subassembly formed by a hollow tubular insert axially mounted in a hollow tubular body for joint rotation. A piston mounted in the insert completes the subassembly. A second subassembly includes a cartridge which holds the cosmetic and a cap fitting over the cartridge for covering the cosmetic. The two subassemblies are then mounted together to form the finished applicator. FIGS. 1–7, for example, illustrate an applicator 10 in accordance with this invention. As shown therein, the applicator 10 includes an outer body member 12 with the rear portion of an insert 14 extending outwardly from the rear end of the body member 12. Within the applicator is a cartridge 16 having an annular flange 18 against which the forward end of the body member 12 abuts. The cosmetic 20 extends outwardly from cartridge 16. A cap 22 covers the forward end of the cartridge to conceal and thereby protect the cosmetic.

Figure 8:
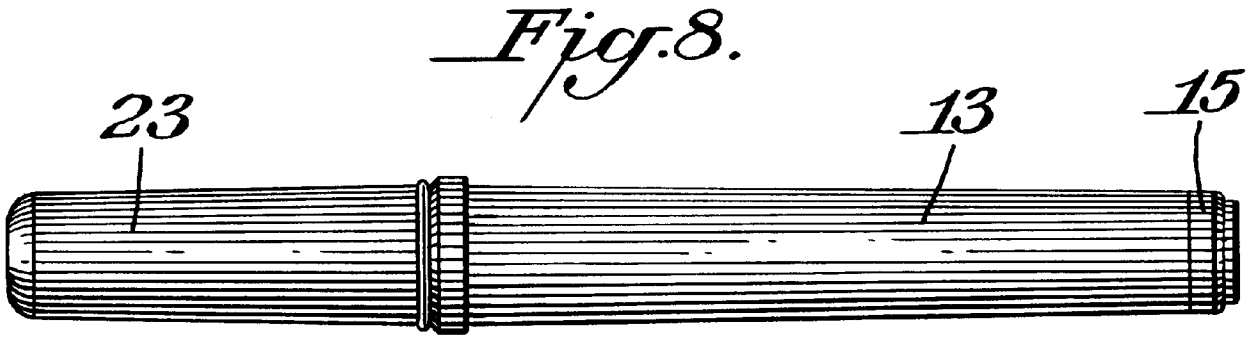
FIG. 8 is a side elevational view of a modified form of applicator in accordance with this invention.
Figure 9:
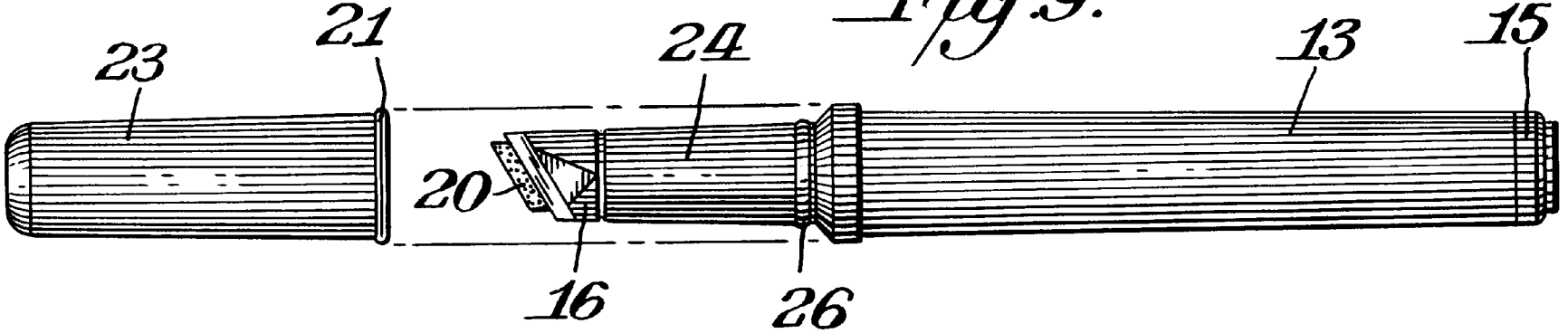
FIG. 9 is an exploded view of the applicator shown in FIG. 8 with the cap removed.
Figure 10:
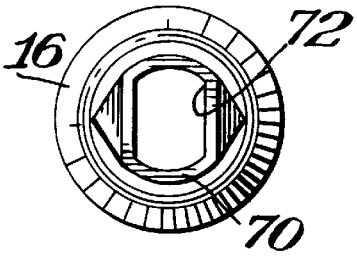
FIG. 10 is a front elevational view of a cartridge used in the applicator of this invention.

The various components may be made of any suitable material such as plastic and preferably ABS plastic. Alternatively, various components may be made of metal or may have metal sleeves over the plastic. FIGS. 8–9, for example, illustrate a metal sleeve 23 over the plastic cap with a ring inside the plastic cap 22 engaged with a ring (not shown) in the sleeve to lock the sleeve 23 to the cap 22. A metal sleeve 24 is over the plastic cartridge 16 with the front end of the cartridge exposed through the metal. A metal sleeve 13 may also be over the body located against a metal sleeve 15 over the rear end of the insert.

As shown in FIGS. 4, 6, 7 and 9 the cartridge may include an annular projection 26 so that the cap 22 could be locked in place by having an internal recess snap over the projection 26.

Figure 15:
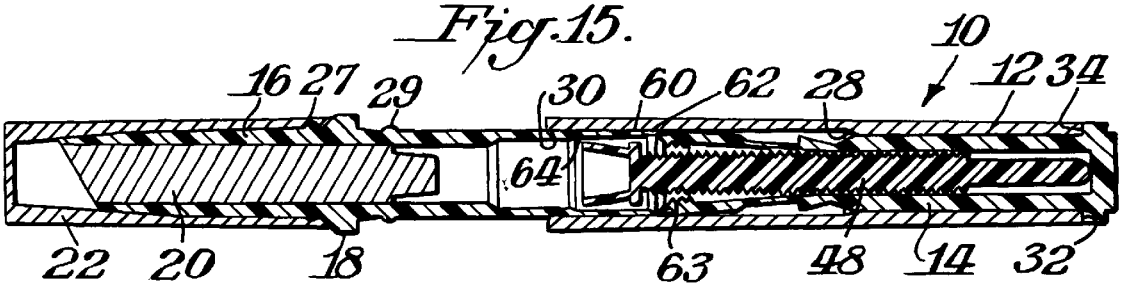
FIG. 15 is a cross sectional view in elevation showing an initial stage of mounting the cartridge and cap assembly to the remaining portions of the applicator in accordance with this invention.

FIG. 15 illustrates the various components of applicator 10 in the initial stage of assembly. As shown therein a first subassembly consists of outer body member 12 which is of hollow tubular construction. Body member 12 may be of any suitable dimensions in accordance with the end use. As illustrated the inner surface of body member 12 is circular in diameter and is of stepped construction thereby creating an internal shoulder 28. The outer edge 30 at the forward end of body member 12 is tapered to facilitate entry of the cartridge 16 into the body member. The rear end 32 of body member 12 is completely open and fits against a shoulder 34 of insert 14.

Figure 13:
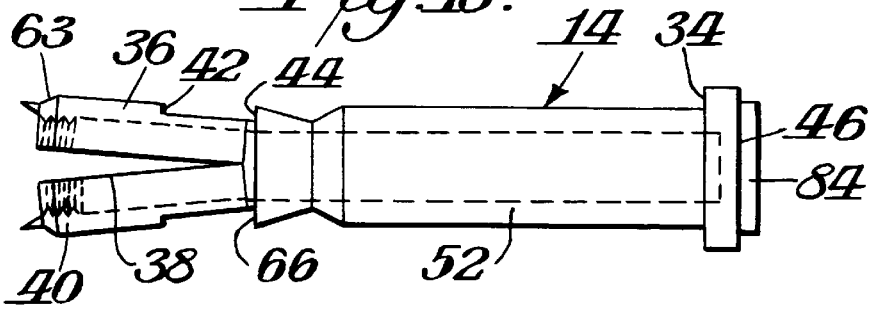
FIG. 13 is a side elevational view of the insert used in the applicator of this invention.

The details of insert 14 are best shown in FIG. 13. As shown therein the forward end 36 includes a pair of diametrically opposite longitudinal slits 38 (only one of which is shown in FIG. 13). Insert 14 is preferably made of a material such as ABS which has enough resiliency that the forward end 36 is ordinarily in its open position shown in FIG. 13 with the edges of the slit spread apart. Screw threads 40 are provided on the inner surface of forward end 36. Forward end 36 also includes a pair of shoulders 42,44 and a closed rear end 46. Insert 14 is of hollow tubular construction except for the closed end 46. The inner surface of insert 14 is circular in cross section.

When insert 14 and body member 12 are secured together the manner of securement is such that body member 12 and insert 14 jointly move. Thus rotation of body member 12 would cause rotation of insert 14. For example, the body member 12 and insert 14 may have a press fit connection.

Figure 11:
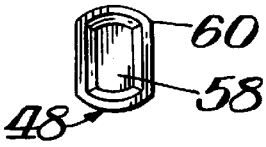
FIG. 11 is a front elevational view of the piston used with the applicator of this invention.
Figure 12:
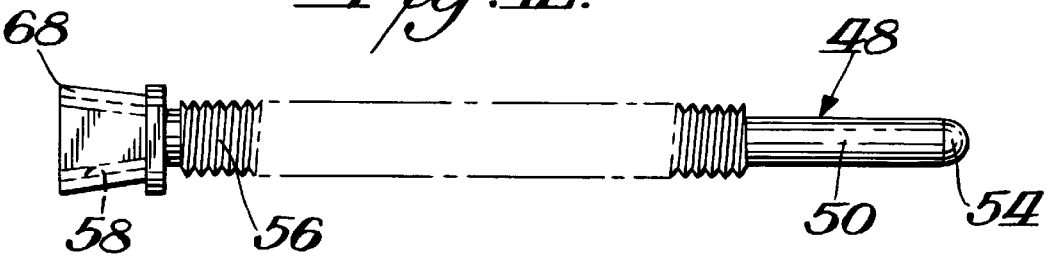
FIG. 12 is a side elevational view of the piston shown in FIG. 11.

FIGS. 11–12 illustrate the details of a piston 48 which is pushed into insert 14. As shown in FIG. 12, as well as FIGS. 15–19, piston 48 includes a smooth outer end 50 of small inner diameter so that end 50 and threaded portion 56 readily fits into the forward end 52 of insert 14. The outer surface 54 of piston 48 is dome shaped to minimize contact with the closed end 46 of insert 14. The outer surface 56 of piston 48 is threaded with a thread which complements and thereby engages the thread 40 on the inner surface of insert 14 when the forward end 36 of insert 14 is in its closed condition as later described. The forward end of piston 48 includes a cup 58 of oval shape as is apparent by comparing FIGS. 16 and 17 and as shown in FIG. 11.

When the threaded portions 40,56 are engaged rotation of body member 12 causes longitudinal movement of piston 48 for purposes later described.

Figure 16:
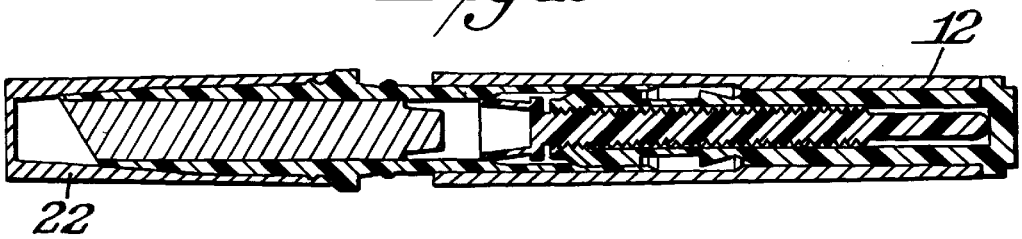
FIGS. 16–18 are views similar to FIG. 15 showing further steps in the assembly of the cartridge and cap to the remaining portions of the applicator of this invention with FIG. 17 being a plan view of the elevational view shown in FIG. 18.

Initially a subassembly would be formed from body member 12, insert 14 and piston 48 as shown in the right hand portion of FIG. 15. The left hand portion shows a second subassembly which comprises cartridge 16, cosmetic 20 and cap 22. This second subassembly is inserted into the first subassembly by pushing the rearward end 60 of cartridge 16 into the forward end 30 of body member 12. Continued longitudinal movement causes the tapered rearward end 62 of cartridge 16 to ride over the tapered edge 63 of insert 14. Continued inward longitudinal movement of cartridge 16, such as shown in FIG. 16, results in the inner surface 64 of cartridge 16 pressing peripherally against the open forward end 36 of insert 14 thereby closing the slits 38 so that threaded engagement results between threaded portions 40 and 56 of insert 14 and piston 48. When cartridge 16 is pushed into its completely assembled position shown in FIGS. 17–18 the rearward edge 62 of cartridge 16 abuts against shoulder 28 of insert 14. Peripheral contact is also made between seal 66 near shoulder 44 of insert 14 and the inner surface 64 of cartridge 16. Further peripheral contact results from the end 68 of cup 58 with the oval shaped inner surface 72 of cartridge 16. Additional contact may result where desired such as between the outer surface of forward end 36 of insert 14 and the inner surface of cartridge 16. All of these locations of peripheral contact may form liquid tight seals.

Because the outer end 70 of cartridge 16 has an oval shape with an oval inner surface 72 which complements the oval shape of cup 58 of piston 48, it is not necessary during insertion to align the oval shapes since the complementary shapes automatically align so that cup 58 may pass through the rearward end 62 of cartridge 16. The alignment of the two oval shapes assures proper orientation of positioning of the components thereby obtaining threaded engagement between the threaded surfaces 40 and 56 and thereby assuring obtaining the proper seals.

The use of a split insert 14 greatly simplifies assembly thereby reducing costs. Because the threaded end of insert 14 is initially in a spread open position there is no contact of insert threads 40 with threads 56 of piston 48. Thus, the piston 48 could be simply longitudinally pushed into insert 14 for assembly. This avoids the need for any rotating motion that would have otherwise been required if threaded portions 40 and 56 were engaged with each other during assembly of piston 48 and insert 14.

The cartridges can be filled from the rear end and the front end opened when filling. In the manufacturing of the piston part and in its assembly, due to the special design of the insert and in its front threaded angle opening, there is no need for unscrewing molds because the threaded piston can simply be pushed into the angled open insert. This eliminates expensive assembly machinery. Additionally, assembly problems are reduced.

Figure 14:
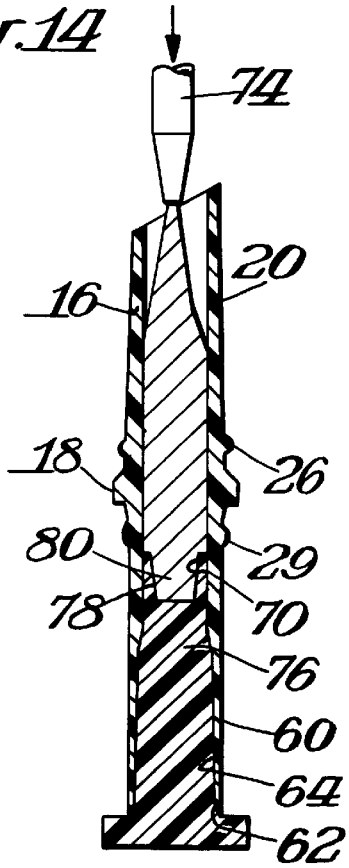
FIG. 14 is a cross sectional view showing a cosmetic such as lipstick being injected into the cartridge for use with the applicator of this invention.
Figure 17:
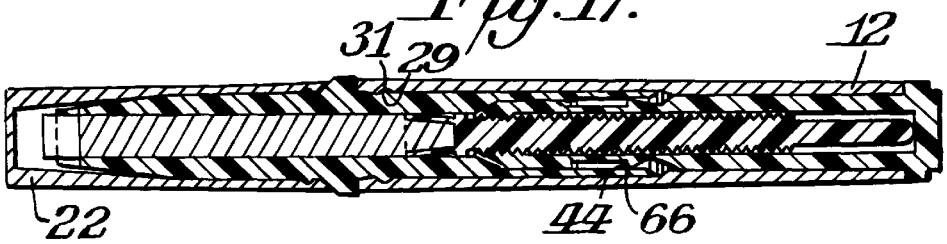
Figure 18:
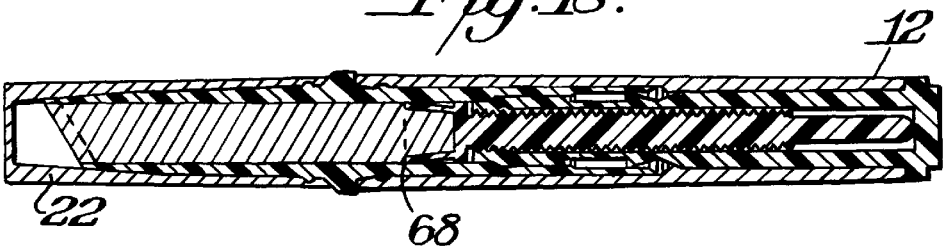
Figure 19:
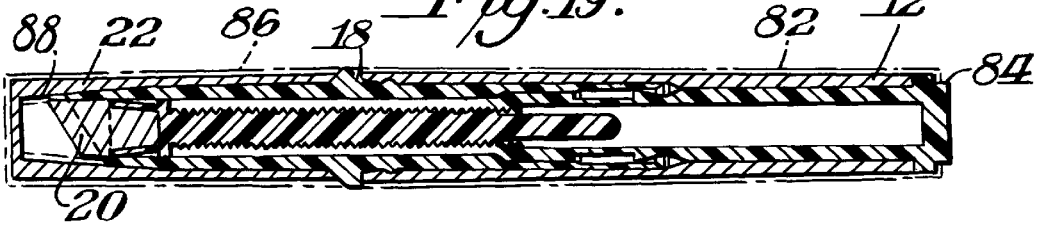
FIG. 19 is a cross sectional view in elevation of a cartridge in accordance with this invention wherein the cosmetic has been almost fully used.

FIG. 14 shows a station in the automatic hot filling of a cartridge 16 with a cosmetic such as lipstick 20. A plurality of such cartridges 16 would be filled from a filling machine that includes, for example, an injection nozzle 74 which would extrude the cosmetic material 20 into the cartridge 16 against a mold plug 76 having the illustrated upper edge surface 78 at its upper end so that the end 80 of the cosmetic 20 would have a complementary tapered oval shape which in turn would snugly fit in the similarly shaped cup 58 of piston 48 when the components are fully assembled such as shown in FIGS. 17–19.

As noted the cartridges can be filled from the rear end. Each filled cartridge 16 would be removed and inserted into the first subassembly with or without a cap 22. This procedure eliminates the conventional steps of filling into a mold, cooling the mold, removing the cosmetic from the mold and inserting the cooled cosmetic into a regular lipstick cup and then turning the lipstick down into the lipstick case. In addition, the elimination of the flaming of lipstick would be achieved.

During the assembly of the two subassemblies the piston cup 58 guides itself into the oval opening 72 of cartridge 16 and the threaded insert automatically closes, as previously described, to cause a threaded connection between piston 48 and insert 14. The seals are also formed on the inside of the cartridge 16.

When the various components have been assembled engagement is assured by the provision of complementary locking structure to form various snap lock engagement. For example, cartridge 16 includes an annular projection 26 which engages in a recess 27 on the inner surface of cap 22. Similarly, cartridge 16 includes an annular projection 29 which engages in recess 31 on the inner surface of body member 12.

If desired, as shown in phantom in FIG. 19, metal covers could be permanently mounted over various components. For example, a metal cover 82 could be mounted over the body member 12 with one end of the cover 82 abutting against the peripheral flange 18 of cartridge 16 and the other end 84 fitting between the body 12 and closed end 46 of insert 14. A second metal cover 86 could fit over cap 22 and abut against flange 18 of cartridge 16. If desired, cap 22 could also include an inner metal liner or sleeve 88 so as to give the appearance of an all metal applicator.

Depending on the dimensioning, some or all of the seals could be effective to create a liquid type seal or could be a hermetic seal which also prevents passage of air. The use of such seals is particularly advantageous since it greatly enhances the life of the cosmetic in the applicator. For example, a lipstick unit could be left in high temperatures without melting. Once cooled down again the lipstick is ready to use again. The lipstick unit could be filled with a regular conventional lipstick cream formula or with the known color stay solvent based formula. Applicator 10 is particularly useful with the color stay formula which results in a lipstick which does not dry, shrink, break or fall out of the unit. In use, the lipstick could be advanced, for example, 2½ millimeters then used up down to the plastic cartridge and then wiped off clean. When advanced again the lipstick shape will appear as new every time.

FIG. 19 illustrates the positioning of the various components when substantially all of the cosmetic 20 has been used.

It is to be understood that although the invention has been particularly described with respect to a lipstick cosmetic, other types of cosmetics could be used such as an eyeliner, eyebrow pencil, lip liner, or eye shadow. Where lipstick is used a full size or a slim line applicator may be formed.

What is claimed is:

1. A cosmetic applicator comprising a hollow tubular body member, a hollow tubular insert axially mounted in said body member for joint rotational movement therewith, said insert having a rearward end and a forward end, said forward end having at least one longitudinal slit extending inwardly from its outer forward edge, said forward end being made of a material tending to have said slit in an open condition, said forward end having a threaded inner surface, a piston axially mounted in said insert, said piston having a threaded outer surface disposed for threaded engagement with said threaded inner surface of said forward end of said insert, a hollow tubular cartridge having a forward end and a rearward end, said rearward end of said cartridge being disposed around said forward end of said insert to urge said slit to a closed condition and to cause said threaded inner surface of said forward end of said insert to be in threaded engagement with said threaded outer surface of said piston whereby rotation of said body causes axial movement of said piston in said insert, a cosmetic in said cartridge extending out of said forward end of said cartridge, said piston having an outwardly disposed cup extending into said cartridge, said cosmetic being seated in said cup whereby forward movement of said piston into said cartridge causes said cosmetic to move outwardly of said cartridge, said inner surface of said cartridge making peripheral sealing contact with an edge on said insert to create a first liquid tight seal, said cup of said piston making sliding sealing peripheral contact with said inner surface of said cartridge to create a second liquid tight seal, and a cap removably mounted over said forward end of said cartridge and over the portion of said cosmetic extending from said cartridge.

2. The applicator of claim 1 wherein there are two diametrically oppositely located slits extending inwardly from said outer forward edge of said insert.

3. The applicator of claim 1 wherein said cup includes an outer surface which forms said sliding seal, said cosmetic being in surface contact with said inner surface of said cartridge, and the portion of said cosmetic in said cup being of smaller cross section than the portion of said cosmetic extending out of said cup.

4. The applicator of claim 3 wherein said cup has a non-circular outer surface for fitting in a complementary opening of said cartridge.

5. The applicator of claim 4 wherein said non-circular shape is oval.

6. The applicator of claim 5 wherein said body member and said insert are press fit to provide for said joint rotational movement.

7. The applicator of claim 1 wherein each of said liquid tight seals are also hermetic seals.

8. The applicator of claim 1 including a third liquid tight seal between a further inner surface of said cartridge and a further edge on said insert.

9. A cosmetic applicator comprising a hollow tubular body member, a hollow tubular insert axially mounted in said body member for joint rotational movement therewith, said insert having a rearward end and a forward end, said forward end having at least one longitudinal slit extending inwardly from its outer forward edge, said forward end being made of a material tending to have said slit in an open condition, said forward end having a threaded inner surface, a piston axially mounted in said insert, said piston having a threaded outer surface disposed for threaded engagement with said threaded inner surface of said forward end of said insert, a hollow tubular cartridge having a forward end and a rearward end, said rearward end of said cartridge being disposed around said forward end of said insert to urge said slit to a closed condition and to cause said threaded inner surface of said forward end of said insert to be in threaded engagement with said threaded outer surface of said piston whereby rotation of said body causes axial movement of said piston in said insert, a cosmetic in said cartridge extending out of said forward end of said cartridge, said piston extending into said cartridge and disposed against said cosmetic whereby forward movement of said piston into said cartridge causes said cosmetic to move outwardly of said cartridge, a cap removably mounted over said forward end of said cartridge and over the portion of said cosmetic extending from said cartridge, a plurality of peripheral liquid tight seals formed at spaced locations between the inner surface of said cartridge, and the outer surface of said piston and between the inner surface of said cartridge and the outer surface of said insert, wherein there are two diametrically oppositely located slits extending inwardly from said outer forward edge of said insert, said piston having an applicator receiving cup at its forward end, said cosmetic being snugly mounted in said cup, said cup including an outer edge which forms one of said seals which is a sliding seal, said cup having a non-circular outer surface for fitting in a complementary opening of said cartridge, said non-circular shape being oval, said body member and said insert being press fit to provide for said joint rotational movement, and a plurality of snap lock members on the outer surface of said cartridge for snap lock engagement with said cap and with said body member.

10. The applicator of claim 9 wherein said rearward end of said cartridge having an oval cross-sectional inner surface.

11. The applicator of claim 10 wherein said cartridge and said insert and said piston are made of plastic material.

12. The applicator of claim 11 including a metal cover over said cartridge.

13. The applicator of claim 12 including a metal cover over said body member and further metal covers over said cap and inside said cap and over said rearward end of said insert.

14. The applicator of claim 13 wherein said cosmetic is selected from the group consisting of lipstick, eyeliner, eyebrow pencil, lip liner and eye shadow.

15. The applicator of claim 14 wherein said cosmetic is lipstick.

16. The applicator of claim 15 wherein said seals are air tight.

17. A method of forming a cosmetic applicator comprising forming a first subassembly by inserting a hollow tubular insert axially into a hollow tubular body member, locking the insert and body member together for joint rotational movement, pushing a piston axially into the insert with the piston having a threaded outer surface at its forward end spaced from and out of contact with a threaded inner surface of the insert at the forward end of the insert by means of the forward end of the insert having at least one slit and being in an open position, forming a second subassembly by inserting a cosmetic into a cartridge, inserting the second subassembly into the first subassembly with the rearward end of the cartridge passing between the forward end of the body member and the forward end of the insert to force the forward end of the insert to a closed condition and thereby create threaded engagement between the threaded inner surface of the insert and threaded outer surface of the piston, passing the forward end of the piston into the interior of the cartridge until the piston contacts the cosmetic, and forming a plurality of fluid tight seals at spaced locations about the inner surface of the cartridge.

18. The method of claim 17 wherein the cosmetic is inserted into the cartridge from a filling machine while the cosmetic is in a hot fluid condition.

19. The method of claim 18 wherein the piston has a cup with an oval shaped surface at its forward end and the cosmetic has a complementary shaped rearward end, and snugly fitting the oval shaped end of the cosmetic into the oval shaped cup of the piston.

20. A method of forming a cosmetic applicator comprising forming a first subassembly by inserting a hollow tubular insert axially into a hollow tubular body member, locking and liquid sealing the insert and body member together for joint rotational movement, sealingly pushing a piston axially into the insert, forming a second subassembly by inserting a cosmetic into a cartridge while the cosmetic is in a hot fluid condition, inserting the second subassembly into the first subassembly with the rearward end of the cartridge passing between the forward end of the body member and the forward end of the insert, passing the forward end of the piston into the interior of the hollow cartridge until the piston contacts the cosmetic, and forming a plurality of fluid tight seals at spaced locations on the inner surface of the cartridge by portions of the inner surface of the cartridge peripherally contacting the insert and the piston.

21. A method of forming a cosmetic applicator comprising molding a plastic hollow insert having a forward end and a rearward end with the insert being molded with at least two longitudinal slits extending inwardly from an outer surface of the forward end and with the forward end being spread apart into a non-cylindrical shape having an inner threaded surface, inserting the hollow tubular insert axially into a hollow tubular body member, locking the insert and body member together for joint rotational movement, pushing a piston axially into the insert without rotating the piston to form a first subassembly, forming a second subassembly by inserting a cosmetic into a hollow cartridge, inserting the second subassembly into the first subassembly with the rearward end of the cartridge passing between the forward end of the body member and the forward end of the insert, forcing the forward end of the insert into a cylindrical shape by the inner surface of the cartridge pressing against the outer surface of the insert, threadably engaging a threaded outer surface of the piston with the threaded inner surface of the insert when the forward end of the insert is in its cylindrical shape, passing the forward end of the piston into the interior of the hollow cartridge until the piston contacts the cosmetic, and covering the forward end of the cartridge and of the cosmetic with a cap.

* * * * *